US009796397B2

(12) United States Patent
Ma et al.

(10) Patent No.: US 9,796,397 B2
(45) Date of Patent: Oct. 24, 2017

(54) SLIDING-PLUG MOVEMENT MECHANISM DEVICE BASED ON VIRTUAL LINEAR MOVEMENT GUIDE RAIL AND FOR SLIDING-PLUG DOOR

(71) Applicant: JIANGSU UNIVERSITY, Jiangsu (CN)

(72) Inventors: Lvzhong Ma, Jiangsu (CN); Qizhi Yang, Jiangsu (CN); Xiuxiang Chen, Jiangsu (CN)

(73) Assignee: JIANGSU UNIVERSITY (CN)

( * ) Notice: Subject to any disclaimer, the term of this patent is extended or adjusted under 35 U.S.C. 154(b) by 0 days.

(21) Appl. No.: 15/127,291

(22) PCT Filed: Apr. 8, 2015

(86) PCT No.: PCT/CN2015/076061
§ 371 (c)(1),
(2) Date: Sep. 19, 2016

(87) PCT Pub. No.: WO2015/154669
PCT Pub. Date: Oct. 15, 2015

(65) Prior Publication Data

US 2017/0137037 A1 May 18, 2017

(30) Foreign Application Priority Data

Apr. 9, 2014 (CN) ..... 2014 1 0139017

(51) Int. Cl.
*E05D 15/10* (2006.01)
*B61D 19/00* (2006.01)
(Continued)

(52) U.S. Cl.
CPC ..... *B61D 19/005* (2013.01); *E05D 15/0608* (2013.01); *E05F 15/652* (2015.01)

(58) Field of Classification Search
CPC .. B61D 19/005; E05F 15/652; E05D 15/0608
(Continued)

(56) References Cited

U.S. PATENT DOCUMENTS 4,091,570 A * 5/1978 Favrel ..... E05D 15/1044 49/118
4,290,368 A * 9/1981 Mazzini ..... B61D 19/026 105/341

(Continued)

FOREIGN PATENT DOCUMENTS

CN 202187648 4/2012 ..... E05F 15/10
CN 203175249 9/2013 ..... E05F 15/10

(Continued)

OTHER PUBLICATIONS

International Search Report and Written Opinion with English translation issued in corresponding application No. PCT/CN2015/076061, dated Jun. 29, 2015 (16 pgs).

(Continued)

*Primary Examiner* — Jerry Redman
(74) *Attorney, Agent, or Firm* — Hayes Soloway P.C.

(57) ABSTRACT

A compartment door for a vehicle has a bearing rod slide block with a rod sliding block arranged on a bearing bar. The bearing rod is connected by a sliding pair, and the compartment door is connected with the bearing sliding block through a plugging and pulling movement of the main body. The plugging and pulling movement of the main body includes a swing rod, a connecting rod and a roller, wherein an upper end of the connecting rod and compartment door are connected to a point B by a rotation pair, and a lower end of the connecting rod and the bearing rod slide block are connected to point D by a sliding pair. The upper end of the (Continued)

swing rod and bearing rod slide block are connected to point A by the rotation pair, and B, C, D are located on a same straight line.

4 Claims, 1 Drawing Sheet

(51) Int. Cl.
*E05D 15/06* (2006.01)
*E05F 15/652* (2015.01)

(58) Field of Classification Search
USPC ..... 49/209, 210, 211, 213, 216, 218, 219, 49/220
See application file for complete search history.

(56) References Cited

U.S. PATENT DOCUMENTS 4,457,108 A 7/1984 Kuschel et al. ..... 49/213
4,924,625 A * 5/1990 Dilcher ..... B61D 19/008 49/212
5,253,452 A * 10/1993 Goldbach ..... B60J 5/062 49/128
5,735,080 A * 4/1998 Pratolongo ..... E05D 15/34 312/325
6,134,838 A * 10/2000 Reddy ..... B61D 19/02 49/116
6,336,246 B1 * 1/2002 Giovannetti ..... E05D 15/1005 16/87 R
6,385,910 B1 * 5/2002 Smink ..... B60J 5/062 49/120
7,364,219 B2 * 4/2008 Lowson ..... B60J 5/062 296/146.1
2005/0235564 A1 * 10/2005 Fronz ..... B61D 19/008 49/209

FOREIGN PATENT DOCUMENTS

CN 103924900 7/2014 ..... E06B 3/50
CN 203783379 8/2014 ..... E06B 3/50
EP 0536528 4/1993 ..... B61D 19/00

OTHER PUBLICATIONS

International Preliminary Report on Patentability issued in corresponding application No. PCT/CN2015/076061, dated Oct. 12, 2016 (7 pgs).

* cited by examiner

SLIDING-PLUG MOVEMENT MECHANISM DEVICE BASED ON VIRTUAL LINEAR MOVEMENT GUIDE RAIL AND FOR SLIDING-PLUG DOOR

FIELD OF TECHNOLOGY

The following relates to a plugging and pulling movement based on virtual linear mobile guide rail about sliding-plug door, which belongs to the technical field of the sliding-plug door.

BACKGROUND

Sliding-plug door is widely used in train doors, cabin doors, aircraft doors, subway doors, car doors and other kinds of transport devices in their compartment doors. At present, the power mechanism of the compartment door can be divided into pneumatic, hydraulic, electric and others. Compartment doors can be categorized according to their movement form such as Sliding-plug door, side by side combination door, revolving door and other different movement forms. In the high-speed train doors, the main form of door is the sliding-plug door. Due to the limitation of space in the body compartment, the transmission mechanism of the door must permit the complete required movement within the limited space. This kind of door needs to complete two movements, one is along the direction of the train i.e. door opening direction and closing direction movements and its form of motion is sliding. The moving distance is slightly larger than the width of the door, about 800-900 mm. In order to meet the urgent situation, human can open the compartment door using backward stroke non self-locking mechanism. Driving mechanism for long distance moving mechanism, such as no self-locking screw mechanism, rack mechanism and flexible transmission (toothed belt transmission), etc. The main driving force is electric power and the transmission form is easy to design and produce. The other movement is perpendicular to the direction of the train and does translation movement, i.e. horizontal plugging and pulling movement. The form of its movement should also be moving, moving distance is smaller, generally is slightly larger than the thickness of the door, about 75 mm. In order to ensure the translational motion of the door, the current mechanism usually used a short guide rails or a swing rod by swing motion to approximately displace it. The movement needs to follow the open motion of the door and it is only in the position which open or close the door making a short movement. This part of the movement is more difficult to design and in order to reduce weight, enhance reliability and reduce cost, the motor power cannot use a single drive motor. Therefore, it often becomes the key difficulty of sliding-plug door. The invention relates to a novel mechanism for improving the difficult part of the traditional plugging and pulling movement. The structure does not have the traditional short guide rail with a small mechanism to achieve the virtual guide rail movement, ensuring that the door always moves at the level of plugging and pulling movement, there is no movement up and down. The virtual guide rail mechanism cancels the short guide rail, and does not have the disadvantage of a small amount of up and down movement by using swing rod motion. It and also has no disadvantage of complex device attached to make up for defects caused by moving up and down. The whole mechanism has the advantages of simple structure, light weight, accurate movement, drive convenient, simple control, lower cost and high reliability.

SUMMARY

Objective of the invention: The disadvantages of current sliding-plug door plugging and pulling movement mechanism structure such as short guide rails, complex structure, inconvenient layout and control, approximate translational motion of the swing rod by swing motion and the complex structure of the modified auxiliary device needs to be rectified for easy operation. This invention proposed a virtual mobile guide rail of sliding-plug door plugging and pulling movement mechanism device with simple mechanism, convenient layout design and from the institutional structure to ensure the compartment door can absolutely do translation plugging and pulling movement. This invention has no short guide rail, however the door connection point along the trajectory is equivalent to running with a guide rail in the same trajectory which is guaranteed by the structure and size of the institution. The inventors therefore call it a novel virtual line moving guide rails sliding-plug door plugging and pulling movement mechanism. The mechanism has the advantages of simple structure, accurate movement, convenient control, low cost and high reliability.

The invention is a key technology of sliding plug door plugging and pulling movement which is the core technology of sliding-plug door. The difficulty of sliding-plug door is the plugging and pulling movement. In order to solve this technical problem, the technical proposal of the invention is achieved in the following ways.

The device comprises of a compartment door, bearing rod slide block with the rod sliding block above arranged on the bearing light bar and the bearing light rod is connected by the sliding pair. Its characteristic lies in the compartment door is connected with the bearing sliding block through the plugging and pulling movement main body and the plugging and pulling movement main body comprises a swing rod, a connecting rod and a roller. The upper end of the connecting rod and compartment door connected to point B by rotation pair and the lower end of the connecting rod and the bearing rod slide block connected to point D by a sliding pair. The upper end of the swing rod and bearing rod slide block connected to point A by rotation pair and B, C, D is located on the same straight line.

In the scheme, the main body mechanism of the plugging and pulling movement is from point A on the upper end of the swing rod to midpoint C on connecting rod. The length of AC is half of the upper end of the connecting rod point B and the lower end of the connecting rod point D of the length of BD.

In the scheme, the upper pulley of the door is fixed on the compartment door and the upper pulley of the compartment door is arranged on the upper pulley track which is fixed on the vehicle body.

In the scheme, the lower end of the compartment door is fixedly provided with a lower guide rail, whiles the lower guide rail and the lower pulley moving side of the door are arranged on the vehicle body connected by sliding pair.

In the scheme, the bearing rod and nut slider is connected with a mesh, while the convex plate is fixed on the bearing light rod and a concave plate is fixed on the nut sliding block. The convex plate and concave plate are connected together.

In the scheme, the nut sliding block is hollow and is provided with a thread and the screw rod connected to the thread. One end of the screw rod is also connected to the motor.

The beneficial effect of the invention is that, compared with the existing sliding-plug door short guide or swing bar technique, the invention avoided short guide rails, changed into a virtual guide rail mechanism which can still achieve a linear translation accurate plugging and pulling movement effect. The whole device has the advantages of simple structure, reduced cost, reduced weight and reliable motion.

Figures 1, 2, 3:
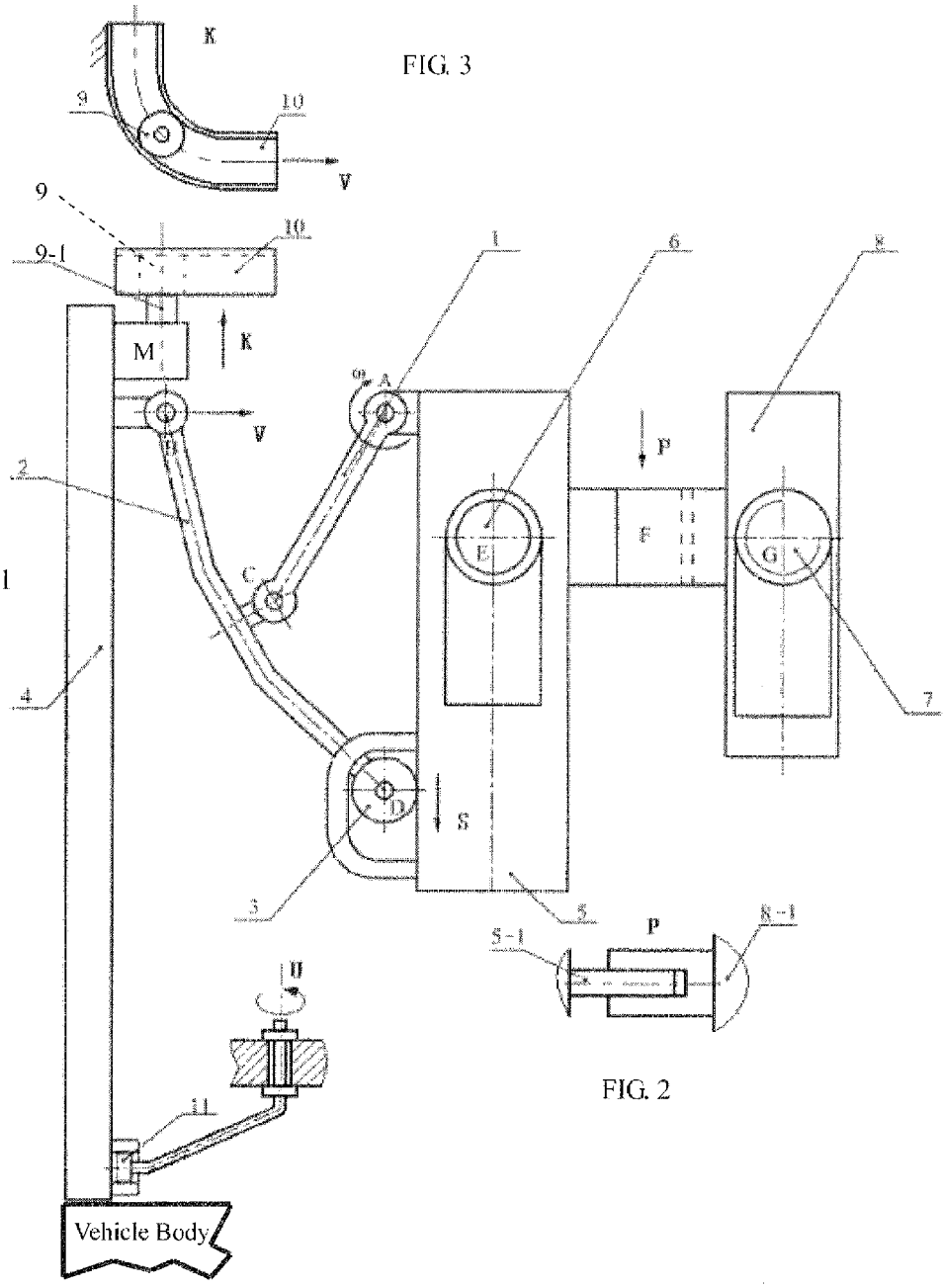
FIG. 1 is a schematic diagram of the mechanism device based on virtual linear moving guide rail of sliding-plug door plugging and pulling movement.
FIG. 2 is a cross-sectional view of a bearing slide block and nut slider element of the mechanism of FIG. 1.
FIG. 3 is a bottom plan view of an upper pulley track element of the mechanism of FIG. 1.

In the drawings the following element numbers apply: 1. Swing rod; 2. Connecting rod; 3. Roller; 4. Compartment door; 5. Bearing rod block; 6. Bearing light rod; 7. Screw rod; 8. Nut slider; 9. Upper roller of compartment door; 9-1. rod; 10. Upper roller track; 11. Lower roller of compartment door; 5-1. Convex plate; 8-1. Concave plate; M-motor; F-bridge.

DETAILED DESCRIPTION

A mechanism device based on virtual linear moving guide rail of sliding-plug door plugging and pulling movement. It is made up of double linear guide rail and five-bar mechanisms with a virtual restraint. Under normal circumstances, the mechanism degree of freedom is zero and it can't move. However, the mechanism is capable of moving when the length of each rod is at a specific length and at this time the mechanism is a virtual restraint. The degree of freedom of the mechanism shall be calculated in accordance with the cancellation of the component and the low pair. At the same time, the degree of freedom of the five-bar mechanisms should be equal to the degree of freedom of the four-bar mechanisms and it can move. With the different requirements of industrial applications, the inventors selected different components and motion pairs as virtual restraint and the selection of different components as driving parts, the mechanism can have different functions. The invention relates to a double linear guide rail and five-bar mechanisms of one double linear guide rails as a virtual restraint and eliminates the linear guide rail (i.e. low pair) with its subsidiary slide block (i.e. component) while the remaining four components are retained. Although the linear guide rail (i.e. low pair) and its subsidiary slide block (component) were eliminated, due to the special nature of the four-bar mechanisms length which is connected with the slide block, the connection point can still be guaranteed according to the original linear guide trajectory. Although the linear guide rail is eliminated, it still can run out of the original linear guide rail track, we call it virtual linear motion guide rails. Connecting points of the virtual linear moving guide rail and the driving point of the sliding-plug door are connected by a rotation pair. In order to ensure that the sliding-plug door can follow the required linear movement along the guide track and complete the plugging and pulling movement of the door, the other guide rail in the original double guide rails is replaced with a roller form having an upper pair form with passive degree of freedom. Along with the change of the motion range of the mechanism, the force of the mechanism is also changing. In order to ensure flexibility of the plugging and pulling movement, different components can be used as the driving component in the mechanism so that the door is lighter, more flexible and reliable when making the plugging and pulling movement. The invention of the plugging and pulling movement is without driving power source alone. The power source is from the drive door opening and closing direction (i.e. train forward direction) of screw motion through the door of the curve guide rail forming action and reaction to push on the door which achieve the door plugging and pulling movement. The employment of the torsion spring force driving the swing rod to rotate in the virtual linear guide rail sliding-plug door plugging and pulling movement mechanism, ensure that the door is always in open state. When the door to needs of the plugging or pulling, used to set in the door frame of bevel mechanism driven original slider guide rail changed to roller forms of upper pair, plugging or pulling the door.

As shown in FIG. 1, the invention main body mechanism is composed of ACBD which is a plugging and pulling movement based on virtual linear mobile guide rail about the sliding-plug door. The ACBD main body mechanism is composed of an AC swing rod (1), a BD connecting rod (2), a roller (3) and a connected bearing rod slide block (5). One end of AC swing rod is connected to the bearing rod slide block (5) by sliding rotation pair A while the other end is connected to connecting rod (2) by rotation pair C. The connecting rod (2) with B, C, D three rotation pairs, connected the compartment door (4), swing rod (1) and roller (3) respectively. Roller (3) and the bearing rod slide block (5) are composed of sliding pairs and the moving direction is along the direction of the AD center line. The bearing rod and nut slider are connected by a bridge F. In order to ensure point B that the connection between AB points and compartment door, the trajectory of AB is always perpendicular to the AD. The rod length of AC is equal to BC which is equal to CD and the value can be altered to 75 mm. The requirements are that the angle BAD is 90 degrees and BCD three points in a straight line when is installed. Due to the length of the mechanism and the particularity of the installation above, if the AC among the mechanism rotated along w, then the point B must be perpendicular to AD and along AB with straight line movement. If point D moves along the direction AD (that is, the direction S), point B in the AB can also be perpendicular to the AD along the AB trajectory. If point B moves along the direction AB, the trajectory of point B can always ensure that AB is perpendicular to the direction of AD with straight line trajectory movement.

In addition to the main body mechanism ACBD, this device is supplemented by compartment door (4), bearing rod slide block (5), bearing rod (6), reverse stroke non-self-locking (i.e. having a large lead) trip screw rod (7) with the screw rod (7) to match the nut slider (8) and the compartment door upper roller (9), upper roller guide rail (10), compartment door lower roller (11) and other components. It is the ACBD mechanism which makes the plugging and pulling movement based on virtual linear mobile guide rail about the sliding-plug door. Point B of the mechanism component (2) is connected to the compartment door (4) by rotation pair B and there is a compartment door upper roller (9) on the top of compartment door. The compartment door upper roller (9) is installed on the upper roller guide rail (10) and the upper roller guide rail (10) is fixed and installed on the vehicle body. The guide rail on the lower end of compartment door is installed on the door, with the door into a whole. The compartment door lower roller (11) is installed on the guide rail of the lower end and can move along the low guide rail as shown in FIG. 1. It is allowed to swing along the U direction when the compartment door makes a plugging and pulling movement. The sliding-plug door plugging and pulling movement discussed above was installed on the bearing rod slide block and makes the movement with the bearing rod slide block together. The compartment door (4) is supported by point B, compartment door upper roller (9) and compartment door lower roller (11). When the controller controls the motor drive, the drive screw rod (7) rotate and promote the nut slider (8) along the train moving direction, namely moving along the door opening and closing direction. The drive bearing rod slide block (5) also moves at this time. The compartment door not only can move with bearing rod slide block (5) together but also the part of bending guide rail on the upper roller guide rail (10) when opening and closing the door give compartment door upper roller (9) the reaction along part force of the direction V as shown in FIG. 1 to K direction view, driving compartment door (4) follow the rotation pair B to move by being perpendicular to the train forward motion direction along virtual linear moving guide rail, that is, as showed in FIG. 1 V is plugging and pulling movement when closing the door. The opposite movement showed in FIG. 1 is the plugging and pulling movement when opening the door. Bearing rod slide block (5) and nut slider (8) are connected by connection pair F. This pair as showed in FIG. 1 P direction view, the upper and the lower has no restraint can prevent the whole component which is connected with the load bearing rod sliding block (5), which comprises the weight of the door and other loads, delivering to the screw rod (7). But at the same time, the motor drive screw rod to (7) to rotate, push the nut slider (8) together along the train along the direction of movement of the force transmitted to the bearing rod slide block (5), driving the compartment door (4) to complete the movement along the train forward or backward direction. The direction and time of rotation driven by motor is controlled by the controller. Please note: in any of the components of the ACBD three movement components which is the main body about the invention of plugging and pulling movement (that is, swing rod (1), connecting rod (2), roller (3)) can be used as a driving component to complete plugging and pulling movements. The characteristics of this movement can provide the diversity and convenience for the driving style of plugging and pulling movement. As mentioned above, with the reaction force of upper guide rail bending part in direction V, completing plugging and pulling movement along direction V, that is, by the reaction force to drive the connecting point B on connecting rod 2, taking connecting rod 2 as the driving component, completing plugging and pulling movement as an example.

The drive transmission line: If the door needs to be closed the controller is used to control the steering and running time of the motor. The driven screw rod (7) rotate and drives the nut slider (8) along the train forward moving direction which in turn drives the bearing rod slide (5) along the bearing rod to move. This then drives the main body of the plugging or pulling movement ABCD moving as a whole. The driven upper roller of compartment door (9) also moves along the upper roller track (10) in a straight line movement and completes the door movement along the train forward direction (closed) or reverse direction (open) movement when the compartment door (4) moved to near the end point position of the closed door. Because the upper roller (9) of the compartment door enters the curved section of the upper roller guide rail (10), the force of the upper roller track (10) to the counterforce of the upper roller of compartment door (9) is in the V direction. This enables B point on the compartment door (4) along the direction V completes the plugging or pulling movement of closed door. Due to the characteristics of the mechanism, the invention can always ensure that the B point is along the direction that BA is perpendicular to AD and makes virtual linear guide rail movement. The above is the closing process, first along the forward direction of the train, i.e. the upper roller of compartment door (9) in the upper roller track (10) doing straight line movement. When the door is closed, the upper roller of compartment door (9) enters the upper roller track (10) curved section to complete plugging or pulling movement along the V direction and closed the door.

If you need to open the door, the process is the opposite process. First, make the curved section plugging or pulling movement of the guide rail to open the door and then make a straight line movement to open the door.

The drive transmission line: If the door needs to be closed the controller is used to control the steering and running time of the motor. The driven screw rod (7) rotate and drives the nut slider (8) along the train forward moving direction which in turn drives the bearing rod slide (5) along the bearing rod to move. This then drives the main body of the plugging or pulling movement ABCD moving as a whole. The driven upper roller of compartment door (9) also moves along the upper roller track (10) in a straight line movement and completes the door movement along the train forward direction (closed) or reverse direction (open) movement when the compartment door (4) is moved to near the end point position of the closed door. Because the upper roller (9) of the compartment door enters the curved section of the upper roller guide rail (10), the force of the upper roller track (10) to the counterforce of the upper roller of compartment door (9) is in the V direction. This enables B point on the compartment door (4) along the direction V completes the plugging or pulling movement of closed door. Due to the characteristics of the mechanism, the invention can always ensure that the B point is along the direction that BA is perpendicular to AD and makes virtual linear guide rail movement. The above is the closing process, first along the forward direction of the train, i.e. the upper pulley of compartment door (9) in the upper roller track (10) doing straight line movement. When the door is closed, the upper roller of compartment door (9) enters the upper roller track (10) curved section to complete plugging or pulling movement along the V direction and closes the door.

If you need to open the door, the process is the opposite process. First, make the curved section plugging or pulling movement of the guide rail to open the door and then make a straight line movement to open the door.

The invention claimed is:

1. A compartment door for a vehicle, comprising a bearing rod slide block with a rod slide block arranged on a bearing bar, wherein the bearing slide rod is connected by a sliding pair, wherein the compartment door is connected with the bearing slide block through a plugging and pulling movement of a main body, and the plugging and pulling movement of the main body comprises a swing rod, a connecting rod and a roller, wherein an upper end of the connecting rod and compartment door are connected to a point B by a rotation pair, and a lower end of the connecting rod and the bearing rod slide block are connected to point D by a sliding pair, and wherein the upper end of the swing rod and bearing rod slide block are connected to point A by the rotation pair, and B, C, D are located on a same straight line, said door further comprising an upper roller for the door fixed on the compartment door, wherein the upper roller is arranged in an upper roller track which in turn is fixed on a body of the vehicle, and a lower end of the compartment door is fixedly provided with a lower guide rail, while the lower guide rail and a lower roller moving side of the door are arranged on the body of the vehicle connected by the sliding pair.

2. The compartment door according to claim 1, comprising a mechanism adapted for plugging and pulling movement from point A on an upper end of the swing rod to midpoint C on the connecting rod, and wherein a length AC is half an upper end of the connecting rod point B and a lower end of the connecting rod point D of a length BD.

3. The compartment door according to claim 1, wherein the hearing rod and nut slider are connected by a bridge, while a convex plate is fixed on the bearing rod, a concave plate is fixed on the nut slider, and the convex plate and concave plate are connected together.

4. The compartment door according to the claim 3, wherein the nut slider is hollow, a rod is connected to the nut slider, and one end of the rod is also connected to a motor.

* * * * *